United States Patent [19]

Corder et al.

[11] Patent Number: 4,802,353

[45] Date of Patent: Feb. 7, 1989

[54] BATTERY-POWERED DOOR LOCK ASSEMBLY AND METHOD

[75] Inventors: Thomas E. Corder, Danville; James B. Mullin, San Jose, both of Calif.

[73] Assignee: Intelock Corporation, Pleasanton, Calif.

[21] Appl. No.: 83,668

[22] Filed: Aug. 7, 1987

[51] Int. Cl.[4] ..... E05B 47/00

[52] U.S. Cl. ..... 70/277; 70/278

[58] Field of Search ..... 70/277, 27 B, 279–283, 70/214, 220; 200/61.64, 61.67; 361/170, 171, 172

[56] References Cited

U.S. PATENT DOCUMENTS

| | | | |
|---|---|---|---|
| 3,475,932 | 11/1969 | Germanton | 70/220 |
| 3,907,343 | 9/1975 | Goodwin | 292/33 |
| 4,149,212 | 4/1979 | Willach | 70/278 |
| 4,196,422 | 4/1980 | Swigert et al. | 200/61.67 |
| 4,457,148 | 7/1984 | Johansson et al. | 70/278 |

*Primary Examiner*—Robert L. Wolfe

*Attorney, Agent, or Firm*—Flehr, Hohbach, Test, Albritton & Herbert

[57] ABSTRACT

A lock assembly (21) including a movable bolt (28), a movable handle (23) coupled to move the bolt (28) to an open position and a locking assembly (29) mounted for movement between a locked position securing the bolt (28) against movement and an unlocked position releasing the bolt (28) is disclosed. The locking assembly (29) moves in response to movement of the handle (23) and is normally supported in an unlocked position. Movement of the lock assembly (29) by the handle (23) results in moving to a locked position prior to movement of the bolt (28) to an opened position. An electromagnet (31) responsive to an input signal is provided to hold the locking means (29) in the unlocked position and to prevent movement of the locking means (29) to the locked position upon movement of the handle (23). This holding of the locking assembly (29) in the unlocked position permits opening of the bolt (28). Any movement without energization of the solenoid (37, 38) produces immediate locking of the bolt (28) by locking assembly (29), while movement after energization of the electromagnet (31) holds the locking assembly (29) in an unlocked position.

26 Claims, 7 Drawing Sheets

BATTERY-POWERED DOOR LOCK ASSEMBLY AND METHOD

TECHNICAL FIELD

The door lock assembly of the present invention relates, in general to electrically powered door lock assemblies, and more particularly, relates to keyless, digital electronic door locks which employ an electromagnet to unlock the lock mechanism.

BACKGROUND ART

Various approaches have been taken toward the development of electromechanical door locks which can be operated without the use of the key. Keyless door lock assemblies afford the user considerable convenience, and they eliminate the problems associated with lost and stolen keys.

One approach to the provision of an electrically powered door lock assembly is to employ a system in which the door bolt is actually driven by electrical power. Such electric strike door lock assemblies, however, must be powered directly from the building power, and accordingly they are expensive to install and usually must be mounted on the door frame, rather than the door itself.

Another approach has been to employ a battery-powered capacitor circuit which will release a surge of power to drive the motor or energize an electromagnet upon triggering of the circuit. Capacitor-based locks, however, have the disadvantage that they cannot be operated unless they are given sufficient time to recharge the capacitor. Moreover, maintaining the charge on the capacitor results in wasted energy that will shorten battery life.

Electromechanical locks which depend upon electrical power to move the bolt, or to move a lock releasing element, inherently face the problem that the mechanical parts can require significant energy to move. Thus, wear from general use, corrosion and shock from door slams can all result in binding or poor operation of the movable mechanical parts. Accordingly, the approach which is most suitable for a battery-powered lock assembly is for the user to manually move the movable mechanical elements in the assembly through manipulation of the door handle.

U.S. Pat. No. 4,457,148 to Johansson, et al. is typical of a structure employing an electromagnet assembly that is energized based upon a coded input. The user can manipulate the door handle to accomplish all three of: digital input to the electromagnet for energization of the same, closing of the armature in the electromagnet and movement of the locking member therewith, and movement of the bolt mechanism between the locked and unlocked position. The electromagnet power is employed solely to hold the locking element in a position which releases the bolt for movement. Power is not consumed to move the armature or to move the bolt.

One of the disadvantages of the approach taken in the lock disclosed in U.S. Pat. No. 4,457,148 to Johansson, et al. is that the door knob must first be rotated in one direction to close the air gap between the armature and the solenoid and then rotated in a second direction to open the lock. Moreover, input of the combination which activates the electromagnet is also accomplished by manipulating the handle in both directions. While one can easily learn this manipulation process, it is possible to become confused during the manipulating sequence, which can be particularly annoying if the result is that the combination must be re-input.

Accordingly, it is an object of the present invention to provide a battery-powered lock assembly and method in which movement of the mechanical parts is simplified and yet is powered by the user.

Another object of the present invention is to provide a keyless, electromechanical door lock assembly in which the movable armature of the electromagnet is held in a normally closed position eliminating the need to move the armature during opening of the lock.

A further object of the present invention is to provide a battery-powered lock assembly and method which is easier to use, can be opened by rotation of the door handle in either direction, is secure against attempts to open the lock without the proper combination input, is economical to manufacture and minimizes the electrical power required for operation.

Still another object of the present invention is to provide a battery-powered keyless electronic door lock assembly having an improved digital input means for energization of the electromagnet therein.

The battery-powered lock assembly and method of the present invention have other objects and features of advantage which will become apparent from and are set forth in more detail in the accompanying drawing and following description of the Best Mode Of Carrying Out The Invention.

DISCLOSURE OF THE INVENTION

The door bolt assembly of the present invention includes a movable bolt, a movable handle coupled to move the bolt to an open position, and a locking assembly mounted for movement between a locked position securing the bolt against movement and an unlocked position releasing the bolt for movement. The improvement in the lock assembly comprises, briefly, the locking assembly being supported in the unlocked position and moving to the locked position upon movement of the handle prior to movement of the bolt to the open position. The bolt assembly includes electromagnet means responsive to an input signal for energization and positioned to hold the locking assembly in the unlocked position upon energization thereof to prevent moving of the locking assembly to the locked position upon movement of the handle. The locking assembly includes a pivotally mounted arm carrying the electromagnet armature which is held by a cam surface so that the armature is normally in contact with a solenoid portion of the electromagnet. The arm is biased for movement away from contact and is coupled to the handle so that movement of the handle immediately causes the armature to fall away from the solenoid and the arm into a position locking the bolt against movement, unless the solenoid is energized. Upon energization of the solenoid, movement of the handle and opening of a bolt can be readily accomplished. Since the armature is already in contact with the solenoid, handle manipulation is not required to close the air gap. Instead, handle manipulation when the solenoid is not energized immediately locks the bolt before the handle can move the bolt to the open position.

BEST MODE OF CARRYING OUT THE INVENTION

The battery-powered door lock assembly of the present invention employs the basic digital electronic system as set forth in U.S. Pat. No. 4,457,148 to Johansson, et al., and such electronics are not regarded as a novel portion of the present invention. In order to greatly facilitate the ease of opening of electronic locks of the type disclosed in Johansson, et al., the present lock assembly has an improved mechanical structure.

Figure 1:
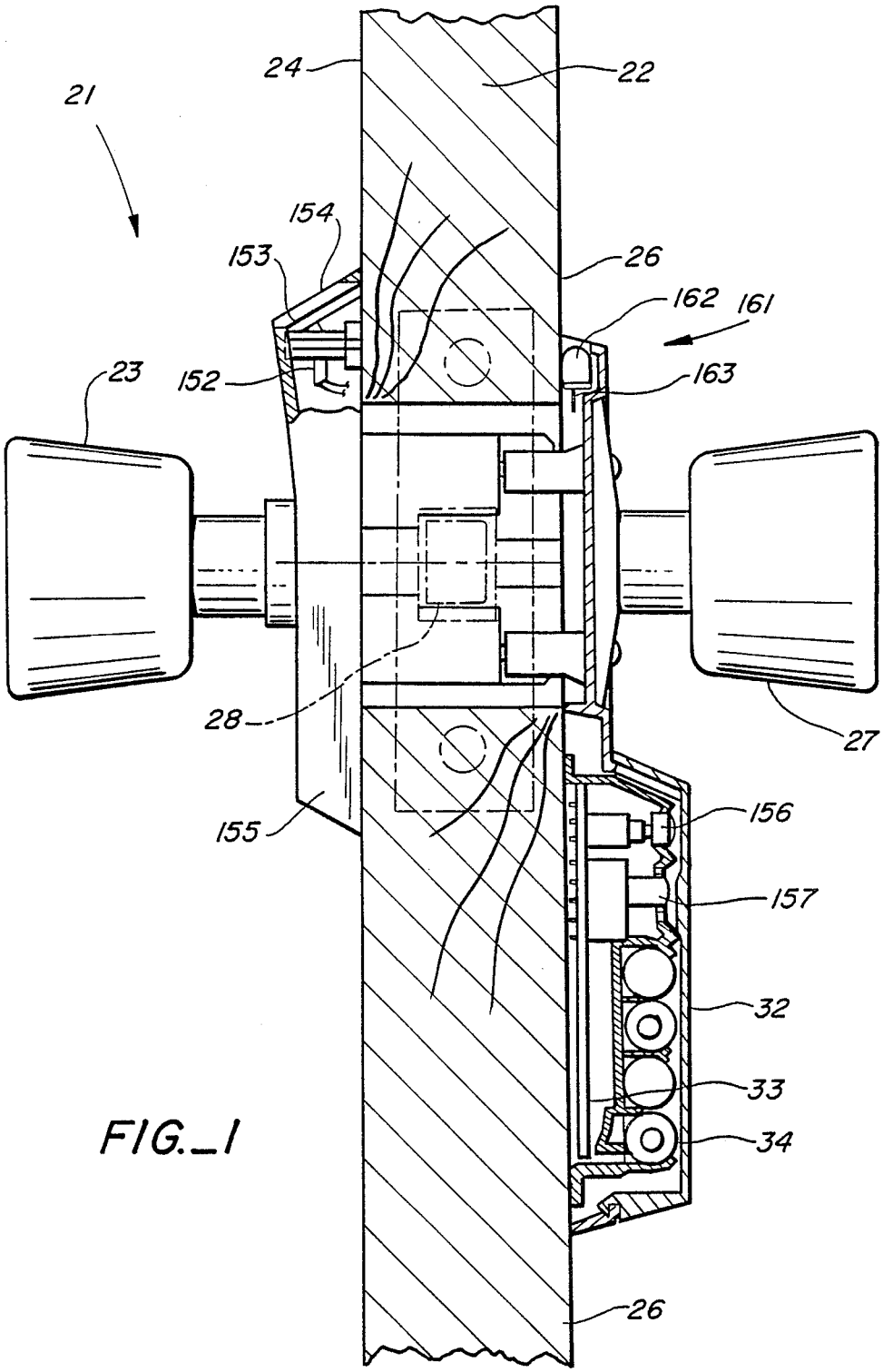
FIG. 1 is a side elevation view, in cross-section, of a battery-powered lock assembly constructed in accordance with the present invention.
Figure 2:
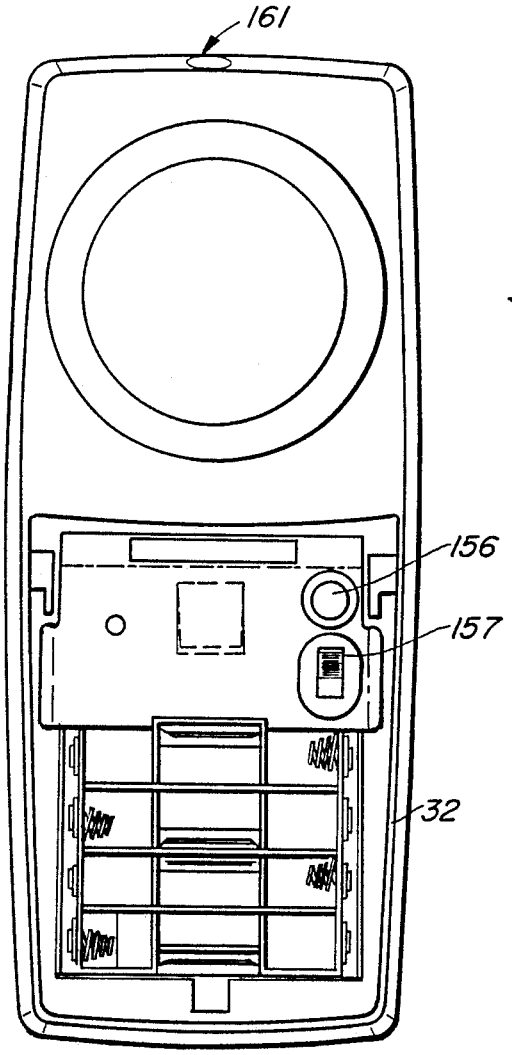
FIG. 2 is an end elevation view internal components of the lock assembly of FIG. 1 with the housing cover removed.

As best may be seen in FIG. 1, the present lock assembly, generally designated 21, is mounted to a door or similar partition 22 with a movable handle 23 on an exterior side 24 of the door. Mounted on interior side 26 of door 22 is a second handle 27. Handles 26 and 27 are coupled to move bolt means 28 (shown in phantom) to an open position. The door lock assembly of the present invention is most preferably used in connection with a bolt 28 which is spring biased to an extended or bolted position. Handles 23 and 27, therefore, move bolt 28 from the bolted, extended position to a retracted, open position. The construction and spring biasing of bolt 28 are not regarded as a novel portion of the assembly of the present invention.

In order to enable locking of bolt 28 in the bolted or extended position, lock assembly 21 further includes locking means, generally designated 29 (FIGS. 5 through 7), formed for movement between a locked position, which secures bolt 28 against movement from the bolted position, and an unlocked position, which releases bolt 28 for movement from the bolted position to an unbolted or retracted position. Lock assembly 29 is coupled for movement in response to both handles 23 and 27 so that manipulation of the handles by the user, not battery powered, is employed to move bolt 28.

The ability to operate lock 21 without the use of a key is facilitated by providing electromagnet means, generally designated 31 (FIGS. 5-7), which may be energized by a digital, combination input as will be described hereinafter. As is true of electronic locks of the type disclosed in U.S. Pat. No. 4,457,148 to Johansson, et al., electromagnet means 31 cooperates with locking assembly 29 to enable unlocking of the lock when the electromagnet is energized.

Lock assembly 21 is provided with a control housing 32 on interior side 26 of the door in which the digital logic circuitry for the lock is housed on circuit board 33. Also mounted in housing 32 are batteries 34 used to power the system and other components which will be set forth hereinafter.

Figure 5:
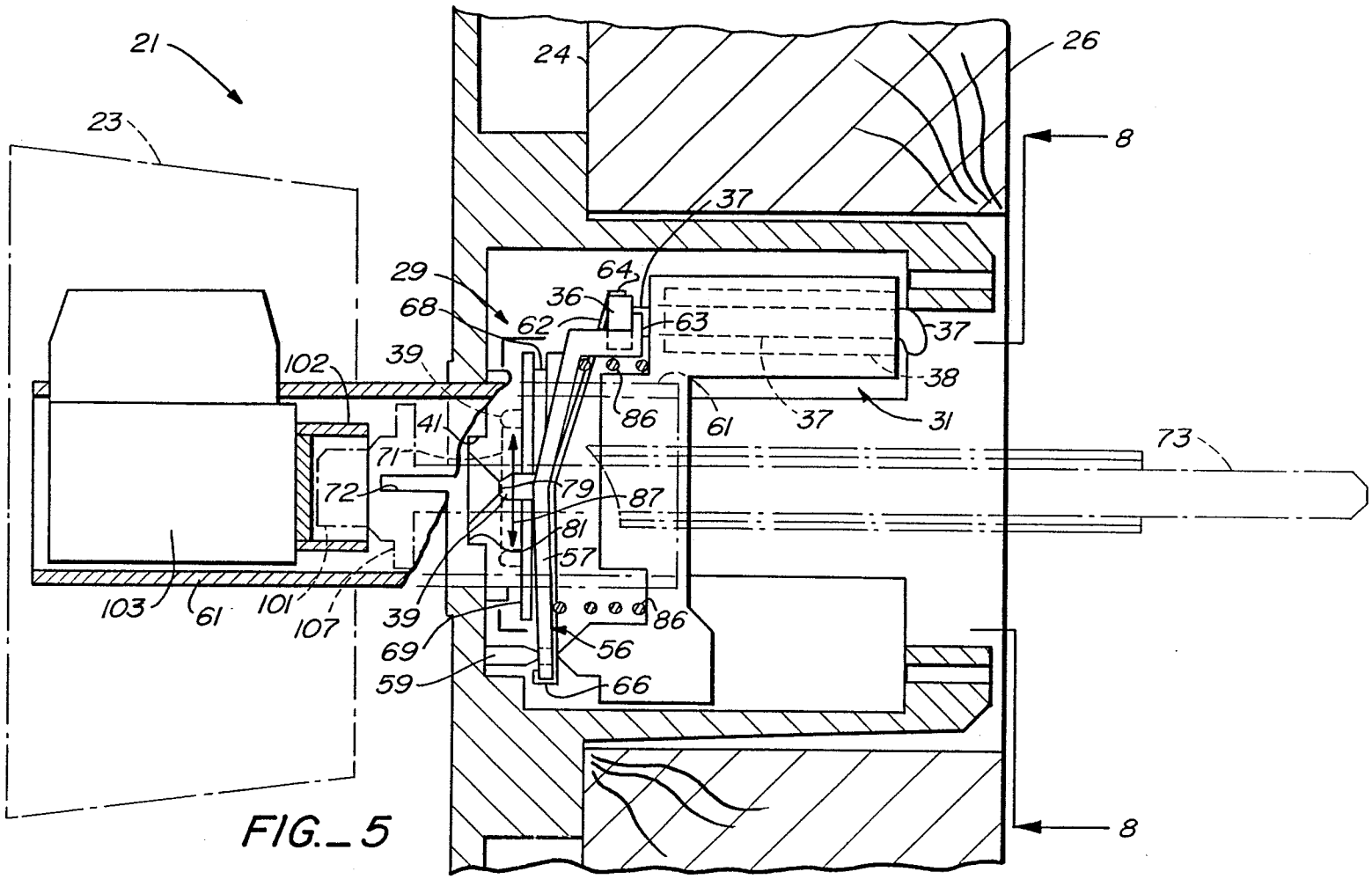
FIG. 5 is an enlarged, side elevation view, in cross-section of the lock assembly of FIG. 1 with certain components removed for clarity and the armature in a normally closed position.

The door lock assembly of the present invention differs from prior electronic door locks in that locking mechanism 29 is normally supported as shown in FIG. 5 in an unlocked position, i.e., if locking mechanism 29 is maintained in the position of FIG. 5 while handle 23 is rotated, the bolt would be retracted to the open or unbolted position. It also will be seen from FIG. 5 that the armature 36 of electromagnet 31 is in contact with core 37 of the solenoid 38 portion of the electromagnet. Upon movement of lock assembly 29 as a result of rotation of handle 23 when lock assembly 29 is not held in the position of FIG. 5, however, the lock assembly immediately assumes the position shown in FIG. 6. Thus, the lugs or followers 39 of lock assembly 29 move from the position of FIG. 5 to the position of FIG. 6 and they engage stops or shoulders 41 which prevent further movement of handle 23 and bolt 28 to an open position. As will also be noted, armature 36 is out of contact with electromagnet core 37 in FIG. 6.

If electromagnet 31 is energized at the time of rotation of handle 23, followers or lugs 39 will move to the dotted line position in FIG. 5, which is above or passes by shoulders 41. Thus, energization of the electromagnet permits rotation of follower 39 through a sufficient angle to enable the handle to open bolt 28 by holding lock assembly 29 against axial movement as the handle rotates. The details of the construction suitable for such operation are described below.

The basic operation of the bolt assembly of the present invention, and an alternative embodiment thereof, can most simply be illustrated by reference to FIGS. 3 and 4. In the prior art electromechanical lock assembly of Johansson, et al., the bolt is initially locked by the Johansson, et al. locking mechanism and the handle is rotated in order to close the air gap in the electromagnet. Once the handle has been rotated and the air gap closed, the energized electromagnet can hold the locking mechanism in an unlocked position for rotation of the handle in a direction unbolting the bolt.

Figure 3:
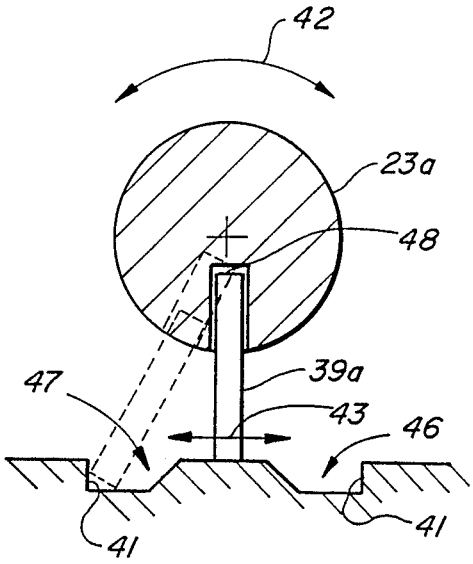
FIG. 3 is an end elevation view of a schematic representation of a handle spindle and locking assembly the present invention.

By contrast in the lock of the present invention as illustrated in FIG. 3, handle 23*a* has associated therewith a locking mechanism which includes a bar or follower 39*a*. The follower 39*a* is free for movement if handle 23*a* is rotated in either direction as indicated by arrows 42 and 43. Thus, the handle is not initially locked against movement to an open position. Upon rotation of handle 23*a*, however, follower or locking bar 39*a* will drop into one of notches 46 and 47 and then abut against a shoulder or stop 41, which will limit further rotation of handle 23*a*. If shoulder 41 is positioned angularly with respect to the handle in advance of the angular position at which the bolt is retracted for opening of the lock, the locking bar 39*a* moves to a locked position prior to movement of the bolt by the handle to an open position. If the upper end 48 of bar 39*a* carries an electromagnet armature (not shown) and is in contact with a solenoid (not shown), energization of the solenoid will hold bar 39*a* against gravity biasing when handle 23*a* is rotated in either direction. Instead of falling into one of notches 46 and 47, bar 39*a* will clear shoulder 41 and the handle can be rotated until the bolt is fully retracted.

Figure 4:
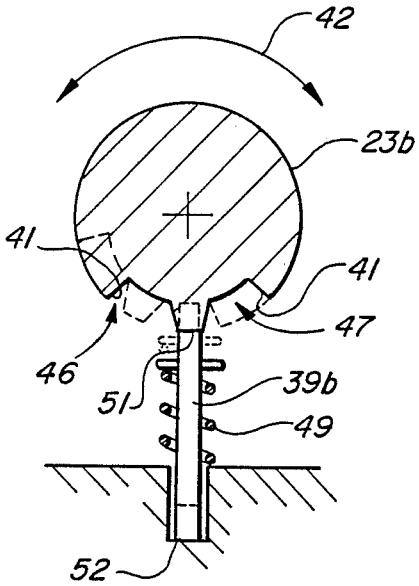
FIG. 4 is a schematic representation corresponding to FIG. 3 of an alternative embodiment of the handle and locking assembly of the present invention.

An alternative schematic embodiment is shown in FIG. 4 in which the parts are reversed. Rotatable handle 23*b* engages an end of a locking bar 39*b* which is biased by a spring 49 upwardly into engagement with a surface 51 on the handle. Rotation of the handle in either direction, as shown by arrow 42, will result in the end of bar 39*b* dropping into one of notches 46 and 47. Rotation of handle 23*b* will be limited when the end of bar 39*b* engages one of the shoulders 41. If an electromagnet armature is mounted to end 52 of bar 39*b*, the bar can be held in the solid line position against the biasing force of spring 49, and the opposite end of the bar will clear shoulders 41 to permit the handle to open or retract the bolt.

While there are several possible mechanical arrangements which can be used to implement either of the schematic representations of FIGS. 3 and 4, the lock assembly of the present invention employs a construction in which substantially the schematic approach of FIG. 3 has been implemented. The lock assembly has been made very compact and suitable for use with many conventional lock assembly components.

Figure 9:
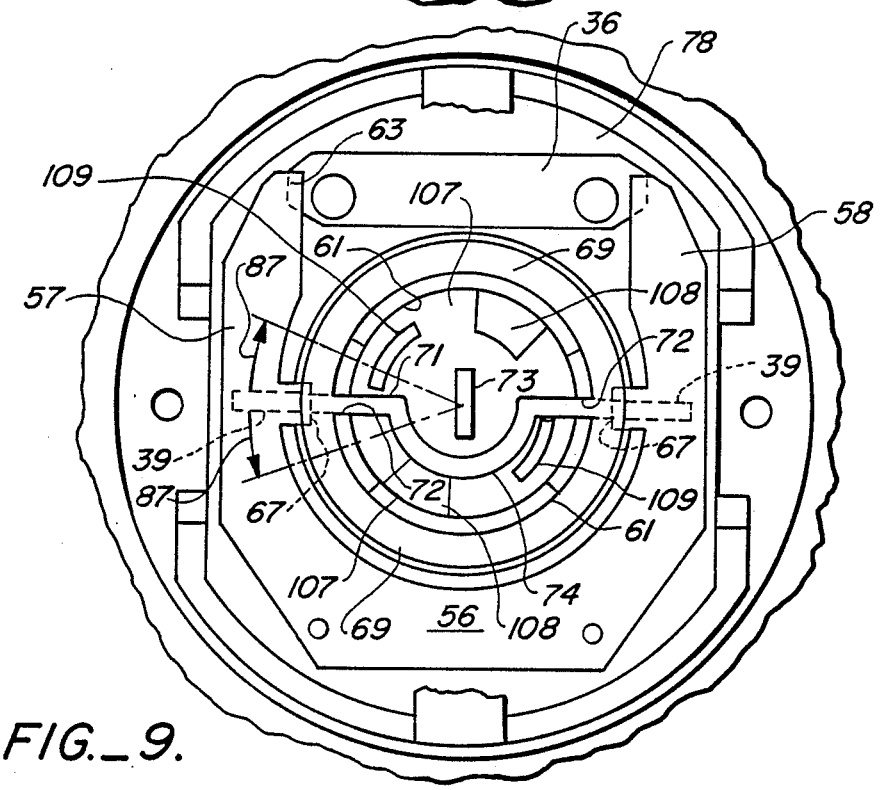
FIG. 9 is an end elevation view taken substantially along the plane of line 9—9 in FIG. 7.

Referring now to FIGS. 5, 6, 8 and 9, the details of construction of one locking assembly suitable for use with the present invention can be set forth. Bolt locking assembly 29 includes a pivotally mounted arm in the form of yoke member 56 having a pair of legs 57 and 58 which extend upwardly from pivotal mounting pins 59 around handle spindle 61. The pivot pins 59 can be seen in FIG. 8 while the plan view of yoke 56 is best seen in FIG. 9. Carried on the upper ends of legs 57 and 58 is armature 36 of electromagnet means 31. The armature is preferably held by a retainer spring 62 which biases armature 36 toward the upward projection 63 on the arms and yet allows armature 36 to be displaced away from projection 63 by a small distance, for example, 0.030 to 0.040 inches, upon engagement of the armature with solenoid core 37. This is an important feature of the mounting of the armature of the present invention since it permits overtravel which insures contact between armature 36 and core 37, which in turn maximizes the magnetic bond between the two. Obviously, armature 36 is formed of a ferromagnetic material, and it is preferable that the remainder of the material proximate electromagnet means 31 be formed of non-ferromagnetic materials.

Figure 6:
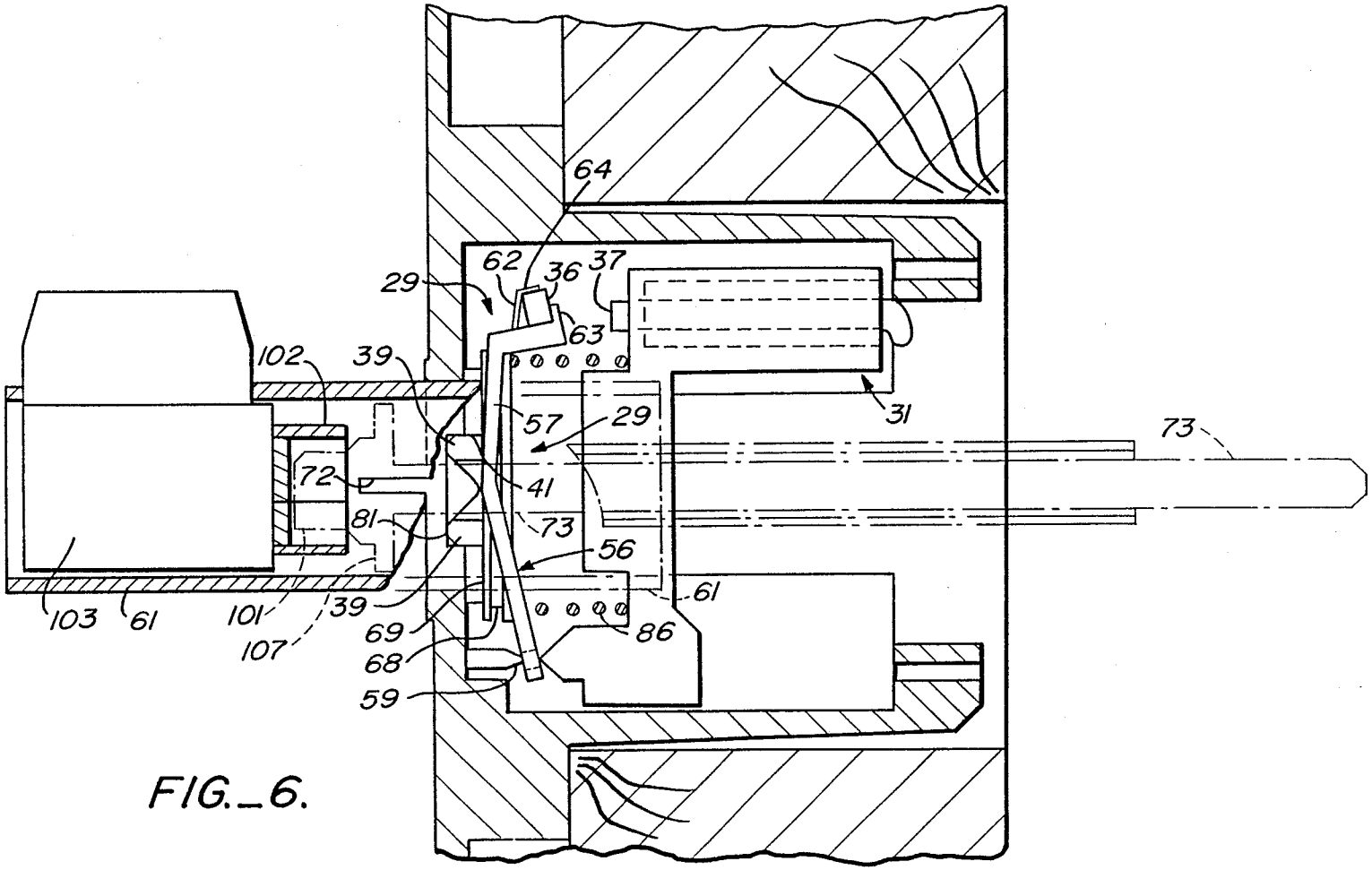
FIG. 6 is a side elevation view corresponding to FIG. 5 with the armature in an open position.

As will be seen from FIGS. 5 and 6, the upper end 64 of spring 62 extends over the top of armature 36 while the lower end 66 is hooked around the bottom of arm 56 so as to apply a force biasing the armature toward the ends 63 of legs 57 and 58.

Yoke 56 includes a pair of inwardly extending tab portions 67 (FIG. 9) which extend into a groove 68 (FIGS. 5 and 6) in a ring member 69. Ring 69 is mounted concentrically with respect to handle spindle 61 and includes a central bar 71 which extends across ring member 69 and through longitudinally extending slots 72 in spindle 61. In order to allow bar 71 to pass around pushbutton drive bar 73, the central portion 74 of bar 71 has a U-shaped configuration (FIG. 9).

Manually engageable handle 23 is coupled to spindle 61 by a structure not shown which is conventional in the art. Rotation of handle 23, therefore, rotates spindle 61, which in turn rotates the longitudinally extending slot 72. Since ring bar 71 extends through slot 72, ring 69 also rotates with spindle 61 and handle 23. Yoke 56, however, does not rotate therewith since the tabs 67 are merely slidably engaged in grooves 68. Bar member 71, however, extends beyond the periphery of ring 69 on the outwardly facing or handle facing side of the ring. On each extension of bar 71 is the lug or cam follower 39 (FIGS. 5, 6 and 9). The position of the two followers 39 on the outward side of yoke 56 can be seen, by comparing FIGS. 8 and 9, to be superimposed over a pair of cam surface means 76 provided in notches or recesses 77 in the front wall 78 of the lock housing. Thus, cam followers 39 cooperate with cam surface means 76 to control the axial positioning of follower 39 with respect to handle spindle 61.

More particularly, cam surface means 76 includes a first portion or end surface 79 having a height which maintains follower 39 in a position which will cause armature 36 to be in contact with core 37. Positioned on either side of first surface portion 79 are second surface portions 81 which are at a height axially displaced away or remote of first surface portion 79 and permit movement of armature 36 away from core 37. Stop means in the form of shoulders 41 defining the edge of notches 77 and interconnecting ramps 82 between the first and second cam surfaces complete the cam surface means.

In order to bias the cam follower and cam surface means together, spring biasing means 86 is mounted to urge ring 69 and arm 56 in a direction toward handle 23. Thus, when spindle 61 is rotated by handle 23, it rotates ring 69. Bar 71 and the extensions or cam followers 39 similarly rotate, as indicated by arrows 87 in FIGS. 5 and 9. As soon as follower moves off of surface 79, however, spring 86 urges the ring and arm assembly toward handle 23, and the follower moves down one of the ramps until it engages stop 41 and rests on surface 81. Thus, the cam followers 39 will move to a position approximated by the two phantom lines on the left side of FIG. 9. Further attempts to rotate the handle, however, are prevented since the follower is locked up against the stationery shoulder 41 in the front wall of the lock housing. Since more rotation is required in order to retract the bolt, the bolt is essentially locked against opening when the cam follower moves down into the notches and against shoulders 41. The use of a pair of cam followers 39 on either ends of ring bar 71 helps balance the force and locking of handle against further movement.

Handle spindle 61 is preferably spring biased to a home or centered position. This can be accomplished by a torsion spring 91 which is mounted in a cup 92 shown in FIG. 7. The torsion spring and cup assembly is well known in the art and includes spring ends which engage spindle 61 so that displacement of the spindle in either direction from the home or centered position produces a torsion biasing force which will return the spindle to the position shown in FIGS. 5 through 7. Accordingly, the home position or centered position of the spindle causes ring and cam follower 39 to be positioned for support of the cam follower on cam surface 79 so that the armature is in a normally closed position and the lock assembly 29 is unlocked.

Opening of the bolt assembly of the present invention can be accomplished by energizing electromagnet 31 before rotating handle 23. Electromagnet 31 generates a magnetic force sufficient to overcome the biasing force of spring 86 on ring 69 and yoke 56. Thus, when the electromagnet is energized, armature 36 will be held against the U-shaped core 37. Accordingly, rotation of handle 23 and spindle 61 after energization of electromagnet 31 will rotate the ring and cam follower 39 without allowing arm 56 to pivot about pin 59 toward the handle. Thus, cam follower moves to the dotted line position shown in FIG. 5 instead of the solid line position shown in FIG. 6. As will be seen, the dotted line position in FIG. 5 allows followers 39 to pass beyond shoulders 41, which in turn allows the handle to be rotated in an amount sufficient to retract bolt 28.

Figure 7:
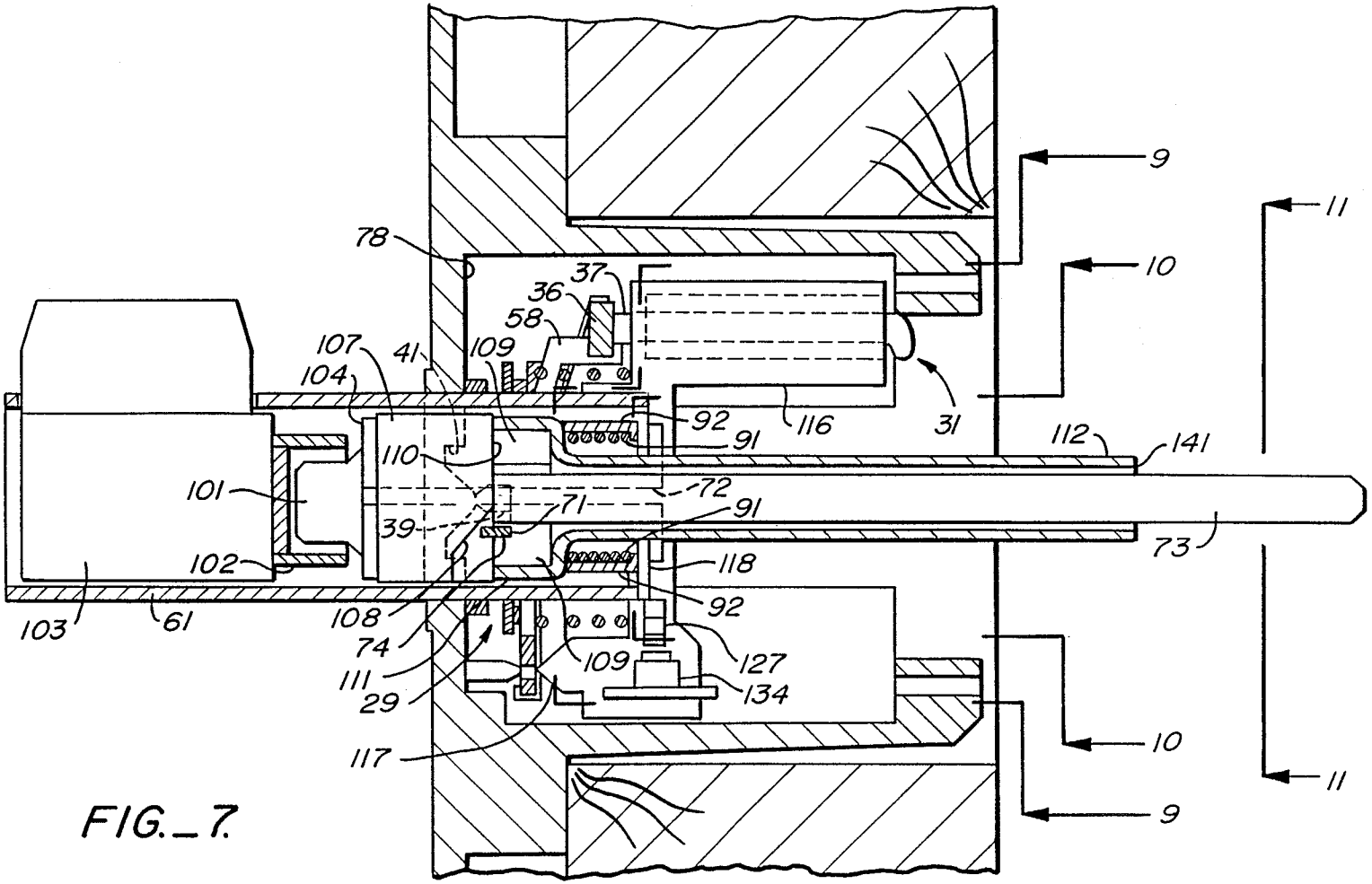
FIG. 7 is a side elevation view corresponding to FIG. 5 with the components omitted from FIGS. 5 and 6 shown.
Figure 8:
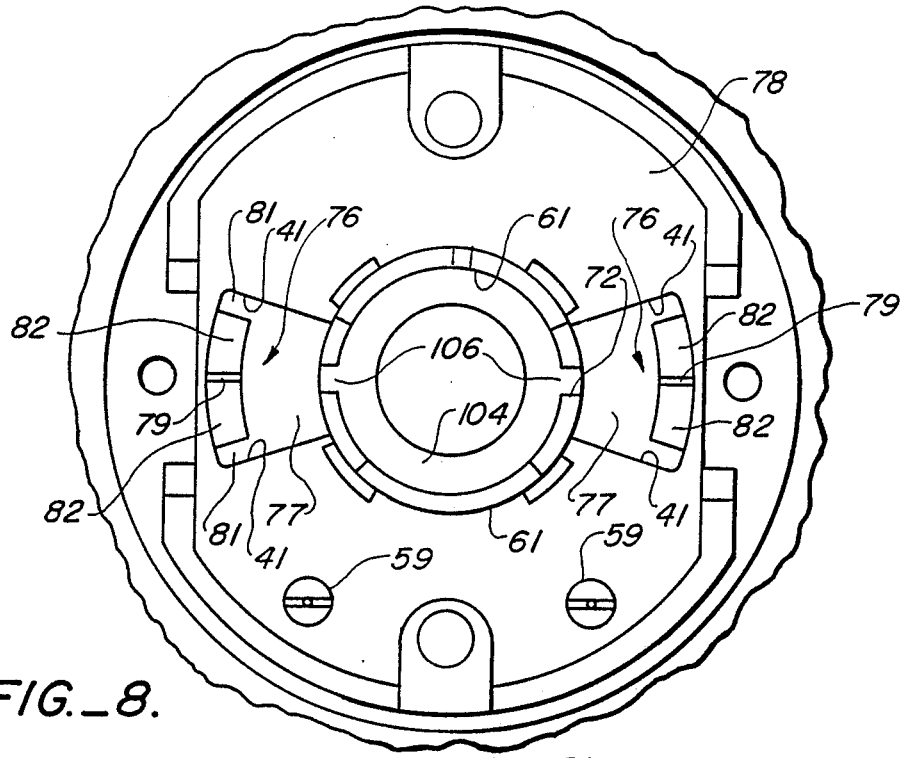
FIG. 8 is an end elevation view taken substantially along the plane of line 8—8 in FIG. 5.
Figure 10:
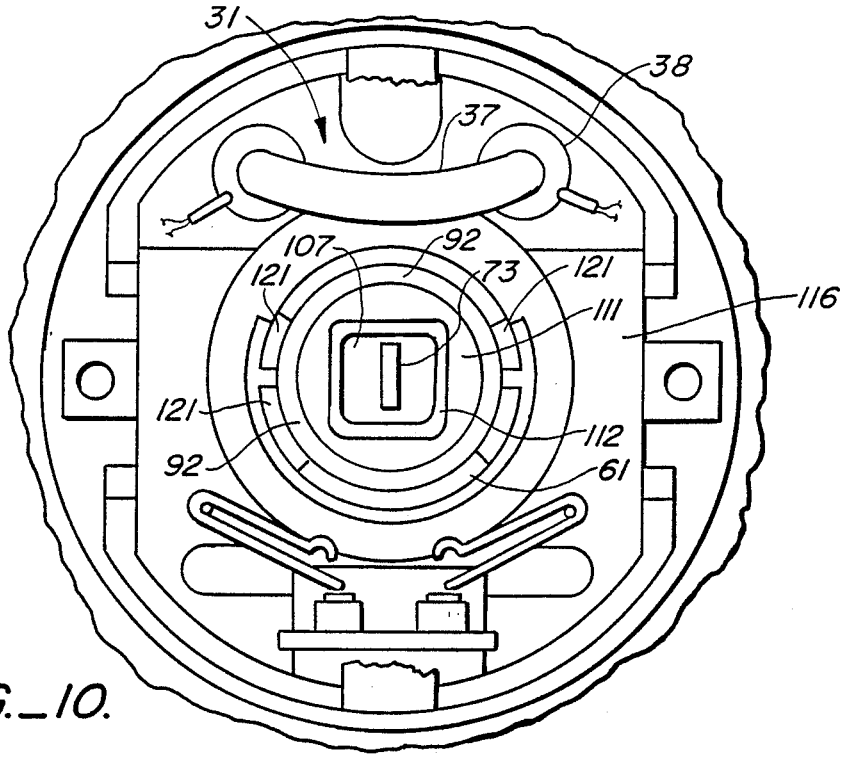
FIG. 10 is an end elevation view taken substantially along the plane of line 10—10 in FIG. 7.

Further details as to the coupling of handle 23 to move bolt 28 and the coupling of the bolt mechanism to the inner handle can best be understood by reference to FIGS. 7 and 10. The bolt assembly preferably includes a panic exit feature which allows the lock to be unlocked simply by rotating inner handle 27, plus an ability to lock the lock mechanism using a thumb turn at the center of inner handle 27 which drives thumb turn bar 73. Thus, bar 73 extends axially from inner handle 27 through an outer end 101 which is received in slotted collar 102 of key tumbler assembly 103. Collar 102 is of a standard construction which will allow end 101 to rotate by 90 degrees without engaging or driving tumbler assembly 103. Mounted at the bottom of spindle slot 72 is a washer 104 having laterally extending tabs 106 which extend into slots 72, as best may be seen in FIG. 8. Washer 104 prevents the end 101 of thumb turn bar 73 from being urged beyond the washer since end 101 includes flanges 107 (FIG. 5 and 6) which bear upon the washer 104.

Mounted on bar 73 next to washer 104 is a cylindrical member 107 having ramp surfaces 108 and upstanding flange portions 109 (FIGS. 7 and 9). Member 107 has a central slot slidably mating with bar 73 so that it rotates therewith. Received upon upstanding flanges 109 is an enlarged end 111 of inner handle drive spindle 112 (FIGS. 7 and 10). The enlarged end 111 of inner spindle 112 is notched to receive transverse bar 71 on ring 69 so that rotation of spindle 112 will rotate ring 69. As also will be seen, inner spindle 112 is rectangular in configuration and is coupled to a similar rectangular opening in the inner handle 27. Torsion spring cup 92 is mounted around inner spindle 112 and provides a torsion centering of the outer spindle 61.

Electromagnet 31 is contained in a housing, preferably formed of plastic, 116 which extends across the cavity in the body of the lock and has at its lower end a pair of pivotal supports 117 for the backside of arm 56. The housing also slidably receives the end of outer spindle 61. Mounted over the end of outer spindle 61 is a cam disk 118 (FIG. 11) with slots 119 therein which receive projecting end tabs 121 on the end of spindle 61. Accordingly, rotation of spindle 61 will produce rotation of cam disk 118.

Bolt 28 extends transversely across inner spindle 112 and is coupled thereto in a standard fashion. Rotation of inner spindle 112 in either direction will retract bolt 28 from its spring-biased extended position.

Figure 11:
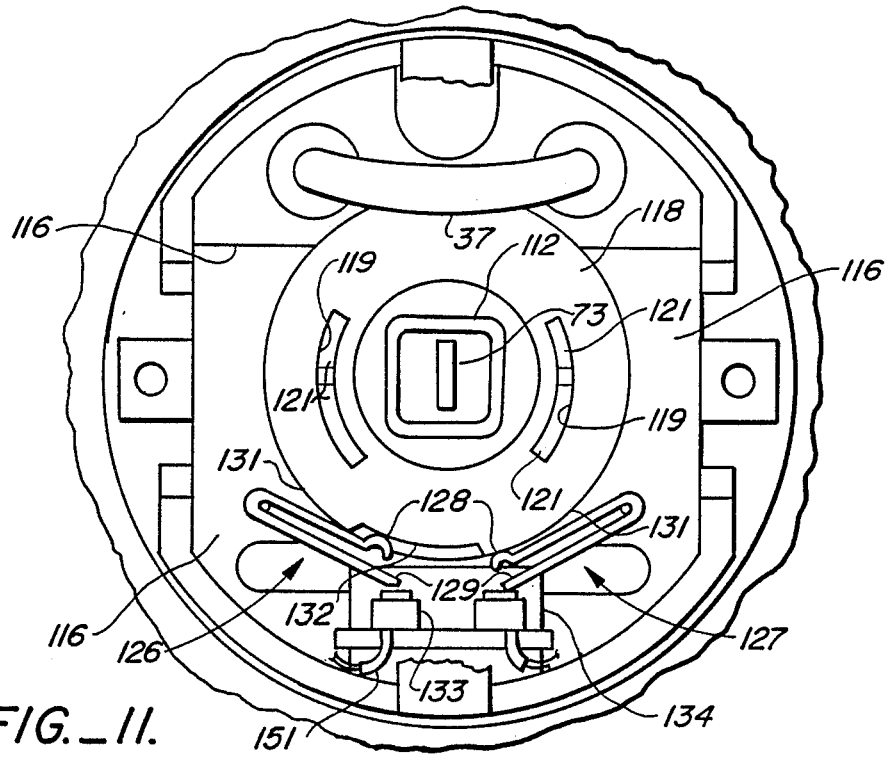
FIG. 11 an end elevation view taken substantially along the plane of line 11—11 in FIG. 7.

Cam disk 118 of bolt assembly of the present invention cooperates with improved digital combination input means. Mounted proximate cam disk 118 are a pair of contact switched elements 126 and 127. Elements 126 and 127 are U-shaped and have a follower end 128 and a contact end 129. Follower end 128 engages the periphery 131 of cam disk 118. The periphery of the cam disk is stepped so as to have an inwardly displaced surface 132 which receives the follower ends 128 of switch elements 126 and 127. As shown in FIG. 11, follower en 128 of switch element 126 is engaged with surface 132. Contact end 129 is in spaced relation with a contact switch 133. Follower 128 of switch element 127, however, is engaged with surface 131 on the cam disk and the opposite contact leg 129 is engaged with cooperating switch 134.

The length of surface 132 is selected so that the limited amount of rotation which cam followers 39 permit before locking up against shoulders or stops 41 will close at least one of switches 126 and 127. Moreover, when the electromagnet is energized and the spindle turned beyond stops 41, both of switches 126 and 127 will close, which is used by the logic circuitry to power down the electromagnet since the bolt will be retracted.

OPERATION

The basic coupling of spindle 61 to bolt 28, therefore, occurs by reason of bar 71 which passes through slot 72 in the spindle. Additionally, the enlarged end 111 of inner spindle 112 is also slotted and passes over bar 71. Accordingly, rotation is transmitted through bar 71 to inner spindle 112. The inner spindle has an end 141 which is driven by inner handle 27 and the enlarged end 111 which is driven by outer handle 23. Any rotation of inner spindle 112 is transmitted into retraction of bolt 28. If the inner spindle rotation is not stopped by followers 39 engaging shoulders 41, the bolt will be retracted sufficiently to clear the striker plate and open the door.

The effect of rotation of the thumb turn on the inner handle 27 is to rotate cylindrical member 107 inside outer spindle 61. When rotated by approximately 90 degrees, ring bar 71 is lifted up ramp 108 and supported on support surface 110. This prevents spring 86 from urging followers 39 down against either of stops 41. Thus, the ring is held in a position above stops 41 permitting free rotation of the inner and outer spindles in either direction to retract the handle. The thumb turn, therefore, can be set by rotating approximately 90 degrees so as to bypass electromagnet 31. As noted above, rotation of the end 101 of bar 73 by about 90 degrees without activating key tumbler 103 is permitted by the slotted collar 102.

The electronic lock assembly of the present invention preferably includes logic circuitry on logic board 33 constructed in accordance with the invention set forth in U.S. Pat. No. 3,812,403 to Gartner. Thus, when the handle is rotated in one direction, switch element 127 contacts switch 133. This closing of the switch will be communicated through electrical conductors 151 to circuit board 33. The circuit board employing the Gartner invention will automatically step up or ramp through a sequence of numbers while indicating the same through conductors 152 to a user visible L.E.D. 153. When the proper number is displayed at L.E.D. 153, handle 23 will be released to stop the ramping operation. This will automatically enter the first number into memory means provided on the circuit board, if the number is a match with a preset code. Turning the handle in an opposite direction will close switch element 127 instead of switch element 126 and ramp or step the input in the other direction. Again, release of the handle will result in torsion centering spring 91 centering the handle, with both of switched elements 126 and 127 opening. This will effect entry of the number into memory if it is a match. It should be noted that L.E.D. 153 is recessed from the top surface 154 of outer housing 155 to provide visual security to the user against observers standing by the lock while it is opened.

The electronic circuitry also includes a code set or reset button 156 which can be used to enter a code into memory against which input must be matched. Additionally, it is preferable that the logic circuitry include a second code select switch 157 which is movable between a first position, allowing opening of the lock or energization of the electromagnet, only when a master code is entered, and a second position, allowing energization of the electromagnet when either of a master code or a temporary code are entered into the lock. The ability to have both a master and a temporary code which will open the lock allows the home owner or landlord to provide authorized temporary personnel or renters with a temporary code. When the code select switch is in the position allowing opening by both codes, the temporary personnel can enter the door. When the home owner or landlord desires to exclude temporary personnel, the code select switch 57 can be moved to the master position.

The lock set can also be provided with a switch which allows a change in rate of the ramping or incrementing of the L.E.D. between a slow rate when one is learning how to use the lock and a fast or normal rate once the technique has been learned.

The master code is entered by switching switch 157 to the master only position and pressing the button 156. To enter the temporary code, the switch 157 is switched to the dual position and code entry button 156 is depressed. The desired numbers are entered into memory the same way the lock is opened. The exterior handle 23 is rotated to close one of the switches and ramp the L.E.D. until the desired number is reached, at which point the handle is released and the number entered. This is continued, in the preferred form of the lock, until four numbers are entered in memory. The logic circuitry also preferably gives a "U" signal at L.E.D. 154 when the proper combination has been entered. This indicates that the electromagnet is energized and the door can be unlocked.

It is also possible to provide the lock assembly of the present invention with a tamper alarm having an acoustic device that can be operated in an instant mode or delay mode, as well as switched off. Such a tamper alarm can be located in housing 32 above switch 156 and can advantageously be constructed in accordance with U.S. Pat. No. 4,196,422.

It also should be noted that the lock of the present invention can also be opened by a mechanical key and tumbler assembly 103. When a key is used, collar 102 will be rotated by more than 90 degrees and the slotted surface will again pick up end 101 of thumb turn bar 73. This will rotate the cylindrical member 107 sufficiently to displace the ring bar 71 up ramps 108 and onto surface 110. This frees spindle 61 for rotation by handle 23 independently of energization of electromagnet 31.

Lock assembly 21 of the present invention further preferably includes means 161 for coupling the operation of electromagnet 31 to the operation of an electromagnet in an adjacent lock assembly. This coupling is described in more detail in commonly owned and contemporaneously filed patent application Ser. No. 083,621, filed 8-7-87, by Thomas E. Corder and John F. Stewart entitled "Bolt Assembly And Method." Coupling means 161 may advantageously be one of a signal transmitter and a signal receiver and most preferably is an optic signal emitter 162 formed to emit signals in the infrared range and coupled by conductors 163 to circuit board 33 so as to generate an encoded signal upon energization of electromagnet means 31. An infrared transducer located on, for example, a dead bolt assembly, can receive a signal from transmitter 162, which indicates that the proper code was input through handle 23 to permit opening of door lock assembly 21. If the code was proper for the door lock assembly 21, it also could be used via optic coupling device 161 to energize an electromagnet which would permit opening of a dead bolt assembly (not shown) adjacent to the door lock assembly.

The circuitry on circuit board 33 further preferably includes an oscillator providing a timing function which can be employed, for example, to energize electromagnet 31 for a limited period of time. Moreover, since both switches 126 and 127 will close when the lock is opened and the spindle rotated beyond the stops 41, the closure of both switches can be used to de-energize electromagnet 31 so as to save power.

Using four triple A batteries and the user's strength to manipulate bolt 26, the battery-powered door lock assembly of the present invention has an expected battery life of 18 months at 10 code unlock operations per day. This assumes further a maximum of 550 alarm operations and that the lock can be opened with an average of about 8 seconds of L.E.D. display power and about 4 seconds of electromagnet power. The circuitry can include a low battery warning which will display an "L" at L.E.D. 154 instead of "U" when the lock is unlocked.

What is claimed is:

1. In a lock assembly including movable bolt means, movable handle means coupled to move said bolt means to an open position, and locking means mounted for movement between a locked position securing said bolt means against movement and unlocked position releasing said bolt means, wherein the improvement in said lock assembly comprises:

said locking means moving in response to movement of said handle means and normally being supported in said unlocked position;

said locking means moving to said locked position prior to movement of said bolt means to said open position upon movement of said handle means; and electromagnetic means responsive to an input signal for energization and positioned to hold said locking means in said unlocked position upon energization thereof to prevent movement of the locking means to said locked position upon movement of said handle means.

2. The lock assembly as defined in claim 1 wherein, said handle means is biased to move to a predetermined home position upon release of said handle means;

said locking means is mounted for movement in response to movement of said handle means from said home position; and said electromagnet means includes an armature means mounted to said locking means and solenoid means mounted proximate said locking means.

3. The lock assembly as defined in claim 1 wherein, said handle means is spring biased to a centered position;

said locking means is mounted for displacement upon movement of said handle means in any direction from said centered position;

said electromagnet means includes armature means carried by said locking means and solenoid means positioned to contact said armature means when said handle means is in said centered position.

4. The lock assembly as defined in claim 3 wherein, said locking means is supported with said armature means in contact with said solenoid means by cam surface means supporting said locking means in said unlocked position, said cam surface means being further formed to permit movement of said armature means away from said solenoid means and to position said locking means in said locked position upon movement of said handle means from said centered position, and said cam surface means being formed to prevent movement of said handle means beyond a position at which said locking means reaches said locked position.

5. The lock assembly as defined in claim 4 wherein, said lock includes stationary frame means; and said cam surface means is provided on said frame means.

6. The lock assembly as defined in claim 4 wherein, said cam surface means is provided on a movable portion of said handle means.

7. The lock assembly as defined in claim 4 wherein, said cam surface means is provided by a surface having two support levels and a stop surface, and said locking assembly is biased toward said cam surface means.

8. The lock assembly as defined in claim 4 wherein, said bolt means is spring biased to a bolted position; said handle means includes input means for energizing said electromagnet means, said input means inputting said electromagnet means to energize said electromagnet means upon movement of said handle by an amount sufficient to move said locking means between said unlocked position and said locked position.

9. The lock assembly as defined in claim 8 wherein, said input means includes switch means actuatable by movement of said locking means by said handle means between said unlocked and said locked positions.

10. The lock assembly as defined in claim 1 wherein, said locking means includes a pivotally mounted arm assembly, a cam follower carried by said arm assembly, spring biasing means biasing said arm assembly for movement away from said electromagnet means, and coupling means coupling said follower means for movement in response to movement of said handle means;

said electromagnet means includes an armature mounted to said arm assembly and a solenoid mounted proximate said arm assembly;

said lock assembly includes frame means having a cam surface thereon, said follower engaging said cam surface during motion of said handle means and said cam surface having a first portion holding said armature in contact with said solenoid and a second portion positioned remote of said first portion permitting movement of said armature away from said solenoid.

11. The lock assembly as defined in claim 10 wherein, said cam surface includes stop means in the form of a shoulder preventing further movement of said follower along said second portion; and said shoulder having a height not greater than the height of said first portion of said cam surface relative to said second portion of said cam surface.

12. The lock assembly as defined in claim 11 wherein, said handle means is biased to return to a centered position upon release of said handle;

said cam surface has a second portion on either side of a central first portion; and said handle means is mounted to move said follower means in either of two opposed directions upon movement of said handle means from said centered position.

13. The lock assembly as defined in claim 10 wherein, said handle means is mounted for rotatable movement upon spindle means having a central axis;

said arm assembly includes a yoke mounted for pivotal movement and having two legs which pass around opposed sides of said spindle means;

said follower means is provided by a follower member mounted for rotation with said spindle means and mounted for movement along said axis, said follower member being further coupled to said yoke to pivot said yoke upon axial movement of said follower member;

said armature being carried between said legs of said yoke; and said spring biasing means biasing said yoke for pivoting away from said armature.

14. The lock assembly as defined in claim 13 wherein, said spindle means includes a pair of opposed axially extending slots;

said follower member is provided as a ring concentrically mounted on said spindle and having internally protruding tabs mounted in sliding engagement with said slots; and said ring further includes a circumferentially extending and outwardly facing guide surface, and said yoke includes means cooperating with said guide surface to couple axial motion of said ring to produce pivotal motion of said yoke without transmitting rotational motion of said ring to said yoke.

15. The lock assembly as defined in claim 14 wherein, said guide surface is a groove and said means cooperating is a pair of opposed inwardly facing tabs on said legs of said yoke.

16. In a lock assembly including movable bolt means, movable handle means biased to a released position and coupled to move said bolt means to an unbolted position, locking means mounted for movement between a locked position securing said bolt means and unlocked position releasing said bolt means in response to movement of said handle means, and electromagnetic means positioned to hold said locking means in said unlocked position upon energization thereof, and including solenoid means and an armature mounted for relative movement between an open position with an air gap therebetween and a closed position in contact with each other, one of said solenoid means and said armature being mounted for movement with said locking means and the other being fixedly mounted, wherein the improvement in said lock assembly comprises:

said solenoid means and said armature are held in contact with each other by at least one of said handle means and said locking means when said handle is in a released position.

17. The lock assembly as defined in claim 16 wherein, said armature is mounted to said locking means and said locking means is biased to move said armature to said open position.

18. The lock assembly as defined in claim 17 wherein, said locking means includes a cam surface and follower means, one of said cam surface and said follower means being coupled for movement in response to movement with said handle means, and one of said follower means and said cam surface being biased toward a remainder thereof.

19. The lock assembly as defined in claim 18 wherein, said locking means includes a pivotally mounted arm assembly having said armature mounted thereto, said arm assembly being coupled to said handle means to pivot said arm assembly in a direction moving said armature away from said solenoid upon movement of said handle means from said released position.

20. The lock assembly as defined in claim 19, and a mechanically actuated key assembly coupled to move said locking means to said unlocked position independently of operation of said electromagnet means.

21. The lock assembly as defined in claim 19, and handle means positioned on an interior side of said lock assembly and coupled to move said locking means to said unlocked position and to move said bolt means to said open position independently of operation of said electromagnet means.

22. The lock assembly as defined in claim 16 wherein, said handle means includes input means for energizing said electromagnet means, said input means includes switch means actuatable by movement of said locking means by said handle means between said unlocked and said locked positions.

23. The lock assembly as defined in claim 22 wherein, said handle means is mounted for rotation;

said switch means includes a cam surface mounted for rotation with said handle means; and said switch means includes follower means mounted proximate said cam surface for contact therewith to open and close said switch means.

24. The lock assembly as defined in claim 16, and one of signal transmitter means and signal receiver means coupling operation of said electromagnet means to operation of a second electromagnet means.

25. The lock assembly as defined in claim 24 wherein, said one of signal transmitter means and signal receiver means is provided by an optic signal emitter in the infrared range coupled to means for transmitting an encoded signal thereby.

26. A method of operation of a lock assembly having a movable bolt, a movable handle having a released position and coupled to displace said bolt between a bolted position and an open position upon movement from said released position, and locking means including a movable member coupled for movement in response to movement of said handle and locking said bolt in said bolted position, and energizable electromagnet means including an armature carried by said movable member and a solenoid positioned to hold said movable member against movement when said electromagnet means is energized comprising the steps of:

supporting said movable member in an unlocked position releasing said bolt for movement and contacting said armature with said solenoid;

biasing said movable member for movement to a position locking said bolt against movement from said bolted position upon movement of said handle from said released position; and holding said movable member in said unlocked position with said electromagnet means prior to moving said handle from said released position to enable movement of said bolt means to said open position.

* * * * *